US008059977B2

(12) United States Patent
Hanfland et al.

(10) Patent No.: US 8,059,977 B2
(45) Date of Patent: Nov. 15, 2011

(54) METHOD AND APPARATUS FOR ADJUSTING NIP WIDTH BASED ON THE MEASURED HARDNESS OF A FUSER ROLL IN AN IMAGE PRODUCTION DEVICE

(75) Inventors: Julie Marie Hanfland, Pittsford, NY (US); William Alexander Burton, Fairport, NY (US); Alvin P. Kromm, Webster, NY (US); Eric Scott Hamby, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 535 days.

(21) Appl. No.: 12/335,962

(22) Filed: Dec. 16, 2008

(65) Prior Publication Data

US 2010/0150587 A1 Jun. 17, 2010

(51) Int. Cl.
*G03G 15/20* (2006.01)

(52) U.S. Cl. ..... 399/45; 399/67

(58) Field of Classification Search ..... 399/45, 399/67

See application file for complete search history.

(56) References Cited

U.S. PATENT DOCUMENTS

| | | | | |
|---|---|---|---|---|
| 4,149,797 | A * | 4/1979 | Imperial | |
| 6,819,890 | B1 | 11/2004 | Bott et al. | |
| 2002/0044803 | A1 * | 4/2002 | Kobaru et al. | |
| 2010/0303493 | A1 * | 12/2010 | Hamby et al. | 399/67 |

* cited by examiner

*Primary Examiner* — David Gray
*Assistant Examiner* — Laura Roth
(74) *Attorney, Agent, or Firm* — Ronald E. Prass, Jr.; Prass LLP

(57) ABSTRACT

A method and apparatus for adjusting nip width based on the measured hardness of a fuser roll in an image production device is disclosed. The method may include receiving an identification of media type, receiving a signal to measure fuser roll hardness, positioning a fuser roll hardness measurement unit onto the fuser roll, measuring the fuser roll hardness, and adjusting the nip width based on the measured fuser roll hardness and received media type identification.

21 Claims, 3 Drawing Sheets

METHOD AND APPARATUS FOR ADJUSTING NIP WIDTH BASED ON THE MEASURED HARDNESS OF A FUSER ROLL IN AN IMAGE PRODUCTION DEVICE

BACKGROUND

Disclosed herein is a method for adjusting nip width based on the measured hardness of a fuser roll in an image production device, as well as corresponding apparatus and computer-readable medium.

The nip width is the measured arc distance created by the intersection of a soft fuser roll and a hard pressure roll in an image production device, such as a printer, copier, multifunction device, etc, which enables heat transfer and pressure needed to fuse prints. If the nip width is not set properly, toner is improperly melted and pressed (fused) against the paper resulting in image quality defects. In addition, improper nip setting can result in excessive wear of the fuser roll surface which results in image quality defects in the form of areas containing unacceptable differential gloss.

An accurate and consistent nip width increases fuser roll life by helping to minimize edge wear on the roll. It has been shown that uneven and excessive nip settings, inboard to outboard, result in accelerated edge wear. The nip width is supposed to be checked and adjusted with every fuser roll replacement. This measurement is not always done and combined with roll Durometer varying significantly from batch to batch, the roll nip widths are frequently incorrectly set. In addition, as the fuser roll ages the softness of the rubber changes resulting in less-than-optimum nip widths.

SUMMARY

A method and apparatus for adjusting nip width based on the measured hardness of a fuser roll in an image production device is disclosed. The method may include receiving an identification of media type, receiving a signal to measure fuser roll hardness, positioning a fuser roll hardness measurement unit onto the fuser roll, measuring the fuser roll hardness, and adjusting the nip width based on the measured fuser roll hardness and received media type identification.

DETAILED DESCRIPTION

Figure 1:
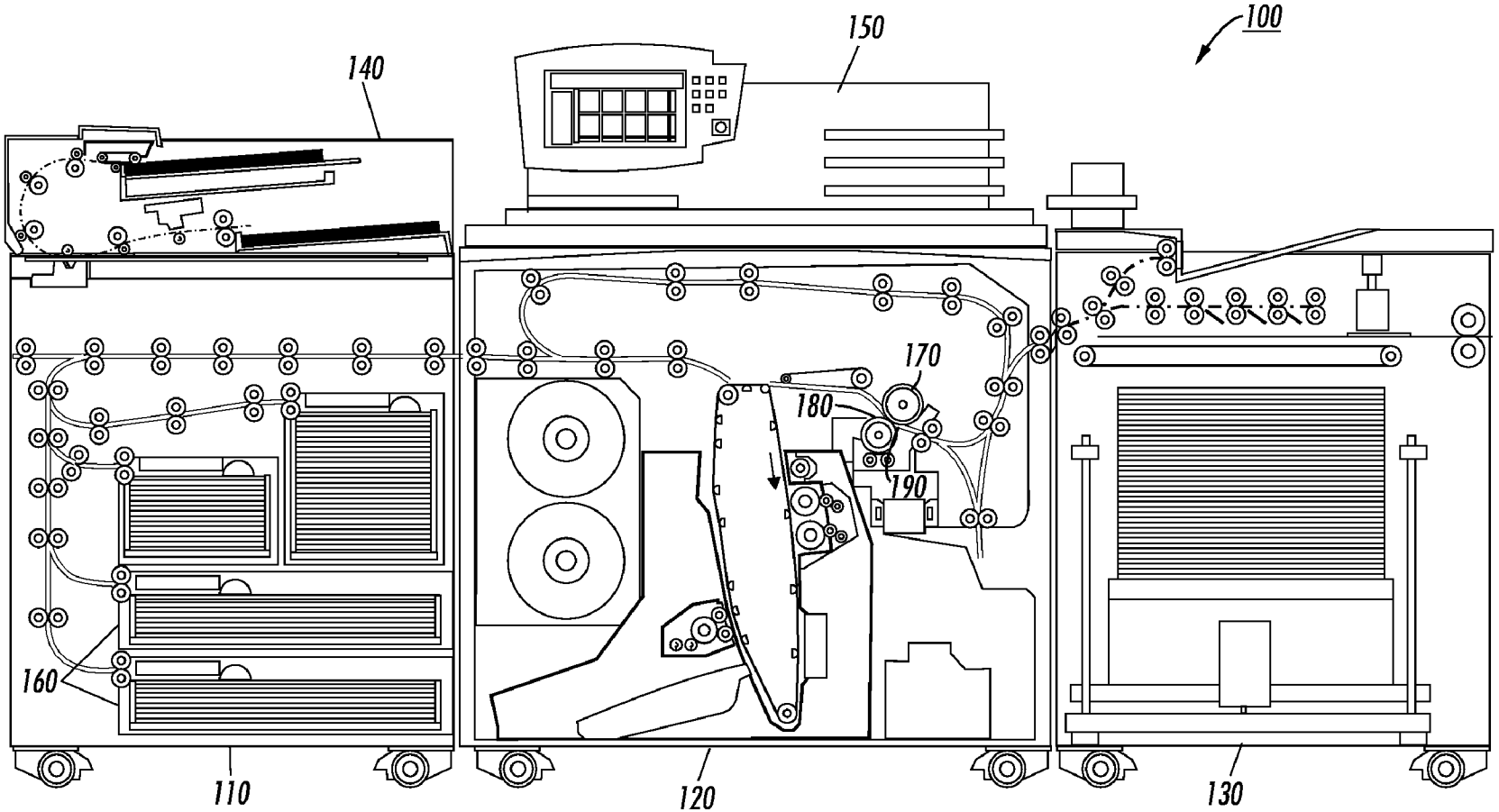
FIG. 1 is an exemplary diagram of an image production device in accordance with one possible embodiment of the disclosure.

Aspects of the embodiments disclosed herein relate to a method for adjusting nip width based on the measured hardness of a fuser roll in an image production device, as well as corresponding apparatus and computer-readable medium.

The disclosed embodiments may include a method for adjusting nip width based on the measured hardness of a fuser roll in an image production device. The method may include receiving an identification of media type, receiving a signal to measure fuser roll hardness, positioning a fuser roll hardness measurement unit onto the fuser roll, measuring the fuser roll hardness, and adjusting the nip width based on the measured fuser roll hardness and received media type identification.

The disclosed embodiments may further include an image production device that may include a fuser roll hardness measurement unit that measures fuser roll hardness, and a nip width adjustment unit that receives an identification of media type, receives a signal to measure fuser roll hardness, positioning a fuser roll hardness measurement unit onto the fuser roll, receives the fuser roll hardness measurements from the fuser roll hardness measurement unit, and adjusts the nip width based on the measured fuser roll hardness and received media type identification.

The disclosed embodiments may further include a computer-readable medium storing instructions for controlling a computing device for adjusting nip width based on the measured hardness of a fuser roll in an image production device. The instructions may include receiving an identification of media type, receiving a signal to measure fuser roll hardness, positioning a fuser roll hardness measurement unit onto the fuser roll, measuring the fuser roll hardness, and adjusting the nip width based on the measured fuser roll hardness and received media type identification.

The disclosed embodiments may concern a method and apparatus for adjusting nip width based on the measured hardness of a fuser roll in an image production device. In particular, the disclosed embodiments may concern an automatic fuser roll compression tester that may be installed in the fuser subsystem. The system may take measurements of the fuser roll hardness and provide data for nip width adjustment. The measurements may be taken on the roll surface away from the fuser roll nip and outside the paper path and inboard and outboard of the fuser roll, for example. A look-up table may provide an appropriate nip width setting based on the measured roll hardness and the paper type. The nip width setting may then be used by the operator or by an automated nip adjustment system.

In a fuser subsystem, one or more miniature compression testers may be mounted outside the nip and paper path along side the fuser roll. One tester may be located on the inboard and the other tester may be located on the outboard end of the soft roll. Alternatively, a single compression tester may used and moved between the measurement areas. After a prescribed number of prints have been fused through the fuser, fuser roll hardness measurements may be taken in a static standby mode, for example.

A couple of readings may be taken at the inboard and outboard ends of the roll. In addition, the fuser roll may be rotated by the main drive motor and another set of measurements may be taken. The measurements may then be averaged to provide the hardness of the roll. The hardness measurements and media type may then be correlated to an appropriate nip width. The optimum nip width may be based on media size, weight, caliper, and type (coated/uncoated). If the predetermined nip width and the actual nip width are different, either an automatic or manual nip adjustment may then take place. Existing and nip width adjustments may be recorded manually or automatically.

Benefits of the disclosed embodiments may include:

- May reduce edge wear on the fuser roll which helps prolong life of the roll and reduce image defects.
- May be used with an automatic nip width adjustment system.

May provide the service person the ideal nip width for the hardness of the fuser roll which may prolong life of the roll and reduce image defects.

FIG. 1 is an exemplary diagram of an image production device 100 in accordance with one possible embodiment of the disclosure. The image production device 100 may be any device that may be capable of making image production documents (e.g., printed documents, copies, etc.) including a copier, a printer, a facsimile device, and a multi-function device (MFD), for example.

The image production device 100 may include an image production section 120, which includes hardware by which image signals are used to create a desired image, as well as a feeder section 110, which stores and dispenses sheets on which images are to be printed, and an output section 130, which may include hardware for stacking, folding, stapling, binding, etc., prints which are output from the marking engine. If the printer is also operable as a copier, the printer further includes a document feeder 140, which operates to convert signals from light reflected from original hard-copy image into digital signals, which are in turn processed to create copies with the image production section 120. The image production device 100 may also include a local user interface 150 for controlling its operations, although another source of image data and instructions may include any number of computers to which the printer is connected via a network.

With reference to feeder section 110, the module may include any number of trays 160, each of which may store a media stack 170 or print sheets ("media") of a predetermined type (size, weight, color, coating, transparency, etc.) and includes a feeder to dispense one of the sheets therein as instructed. Certain types of media may require special handling in order to be dispensed properly. For example, heavier or larger media may desirably be drawn from a media stack 170 by use of an air knife, fluffer, vacuum grip or other application (not shown in the Figure) of air pressure toward the top sheet or sheets in a media stack 170. Certain types of coated media are advantageously drawn from a media stack 170 by the use of an application of heat, such as by a stream of hot air (not shown in the Figure). Sheets of media drawn from a media stack 170 on a selected tray 160 may then be moved to the image production section 120 to receive one or more images thereon.

In this embodiment, the image production section 120 is shown to be a monochrome xerographic type engine, although other types of engines, such as color xerographic, ionographic, or ink-jet may be used. In FIG. 1, the image production section 120 may include a photoreceptor which may be in the form of a rotatable belt. The photoreceptor may be called a "rotatable image receptor," meaning any rotatable structure such as a drum or belt which can temporarily retain one or more images for printing. Such an image receptor can comprise, by way of example and not limitation, a photoreceptor, or an intermediate member for retaining one or more marking material layers for subsequent transfer to a sheet, such as in a color xerographic, offset, or ink-jet printing apparatus.

The photoreceptor may be entrained on a number of rollers, and a number of stations familiar in the art of xerography are placed suitably around the photoreceptor, such as a charging station, imaging station, development station, and transfer station. In this embodiment, the imaging station is in the form of a laser-based raster output scanner, of a design familiar in the art of "laser printing," in which a narrow laser beam scans successive scan lines oriented perpendicular to the process direction of the rotating photoreceptor. The laser may be turned on and off to selectably discharge small areas on the moving photoreceptor according to image data to yield an electrostatic latent image, which is developed with marking material at development station and transferred to a sheet at transfer station.

A sheet having received an image in this way is subsequently moved through fuser section that may include a fuser roll 170 and a pressure roll 180, of a general design known in the art, and the heat and pressure from the fuser roll 170 causes the marking material image to become substantially permanent on the sheet. The nip width 190 is shown as the distance between the fuser roll 170 and the pressure roll 180. The sheet once printed, may then be moved to output section 130, where it may be collated, stapled, folded, etc., with other media sheets in a manner familiar in the art.

Although the above description is directed toward a fuser used in xerographic printing, it will be understood that the teachings and claims herein can be applied to any treatment of marking material on a medium. For example, the marking material may comprise liquid or gel ink, and/or heat- or radiation-curable ink; and/or the medium itself may have certain requirements, such as temperature, for successful printing. The heat, pressure and other conditions required for treatment of the ink on the medium in a given embodiment may be different from those suitable for xerographic fusing.

Figure 2:
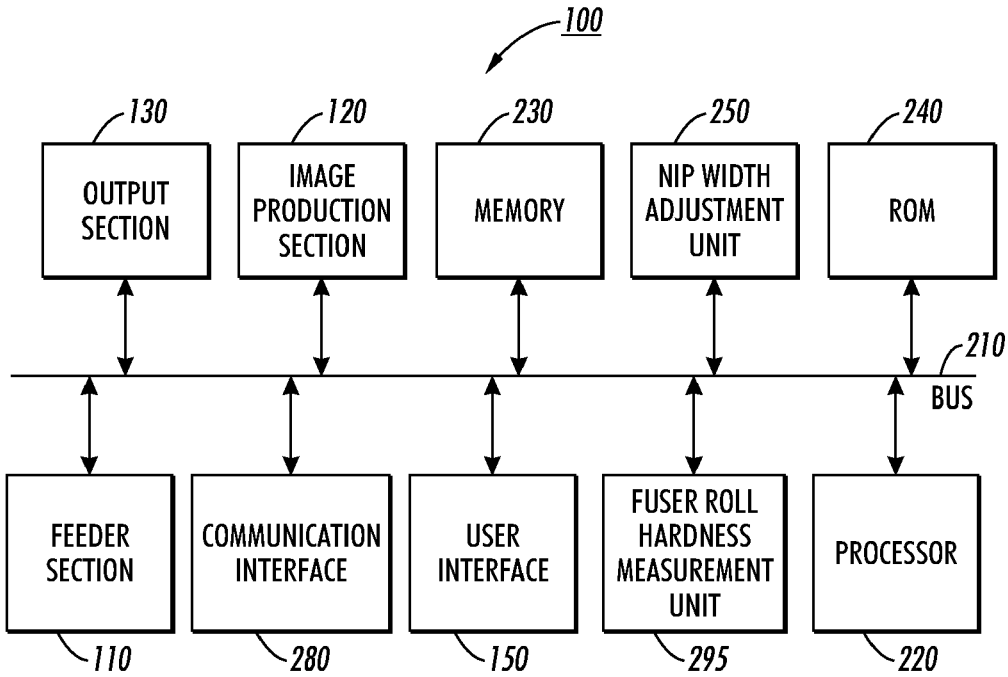
FIG. 2 is an exemplary block diagram of the image production device in accordance with one possible embodiment of the disclosure.

FIG. 2 is an exemplary block diagram of the image production device 100 in accordance with one possible embodiment of the disclosure. The image production device 100 may include a bus 210, a processor 220, a memory 230, a read only memory (ROM) 240, a nip width adjustment unit 250, a feeder section 110, an output section 130, a user interface 150, a communication interface 280, an image production section 120, and a fuser roll hardness measurement unit 295. Bus 210 may permit communication among the components of the image production device 100.

Processor 220 may include at least one conventional processor or microprocessor that interprets and executes instructions. Memory 230 may be a random access memory (AM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

User interface 150 may include one or more conventional mechanisms that permit a user to input information to and interact with the image production unit 100, such as a keyboard, a display, a mouse, a pen, a voice recognition device, touchpad, buttons, etc., for example. Output section 130 may include one or more conventional mechanisms that output image production documents to the user, including output trays, output paths, finishing section, etc., for example. The image production section 120 may include an image printing and/or copying section, a scanner, a fuser, etc., for example.

The image production device 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The image production device 100 illustrated in FIGS. 1-2 and the related discussion are intended to provide a brief, general description of a suitable communication and processing environment in which the disclosure may be implemented. Although not required, the disclosure will be described, at least in part, in the general context of computer-executable instructions, such as program modules, being executed by the image production device 100, such as a communication server, communications switch, communications router, or general purpose computer, for example.

Generally, program modules include routine programs, objects, components, data structures, etc. that performs particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like.

Figure 3:
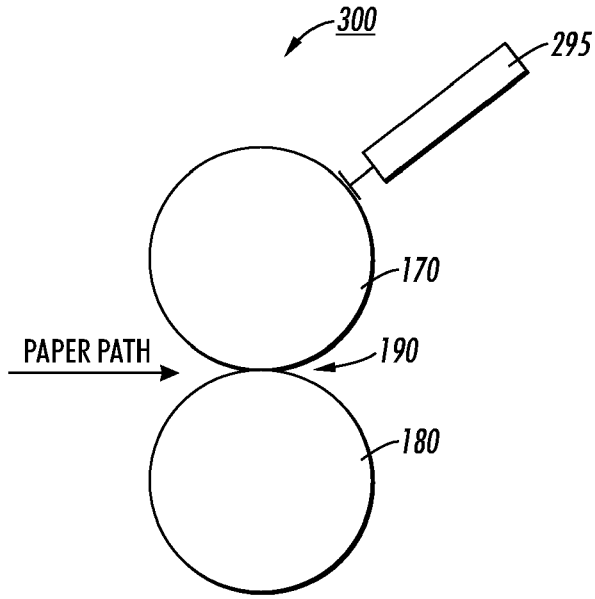
FIG. 3 is an exemplary block diagram of the fuser roll hardness measurement environment in accordance with one possible embodiment of the disclosure.

FIG. 3 is an exemplary diagram of the fuser roll hardness measurement environment 300 in accordance with one possible embodiment of the disclosure. The fuser roll hardness measurement environment 300 may be found in the image production section 120 and may include fuser roll 170, pressure roll 180, and fuser roll hardness measurement unit 295.

The fuser roll hardness measurement unit 295 may be any device that may automatically be positioned to measure the fuser roll hardness. In the exemplary embodiment shown, fuser roll hardness measurement unit 295 may be a compression testing device, for example. However, as one of skill in the art may recognize, other configurations of automatically measuring the fuser roll hardness may be used. In addition, the fuser roll measurement unit 295 may be a separate unit or part of the nip width adjustment unit 250, for example. The fuser roll hardness measurement unit 295 may also include its own processing device and/or memory for processing fuser roll hardness measurements prior to sending to the nip width adjustment unit 250, for example.

If the fuser roll hardness measurement process of the disclosed embodiments dictates, the nip width adjustment unit 250 may change the nip width 190 by adjust the distance between the fuser roll 170 and the pressure roll 180. Note however, that while the disclosed embodiments concern a nip width 190 the distance between the fuser roll 170 and the pressure roll 180, the disclosed process may be applied to any two rolls in an image production device 100 where the rolls must be properly adjusted to allow media to pass through without jamming.

The operation of components of the nip width adjustment unit 250, the fuser roll hardness measurement unit 295, and the fuser roll hardness measurement process will be discussed in relation to the flowchart in FIG. 4.

Figure 4:
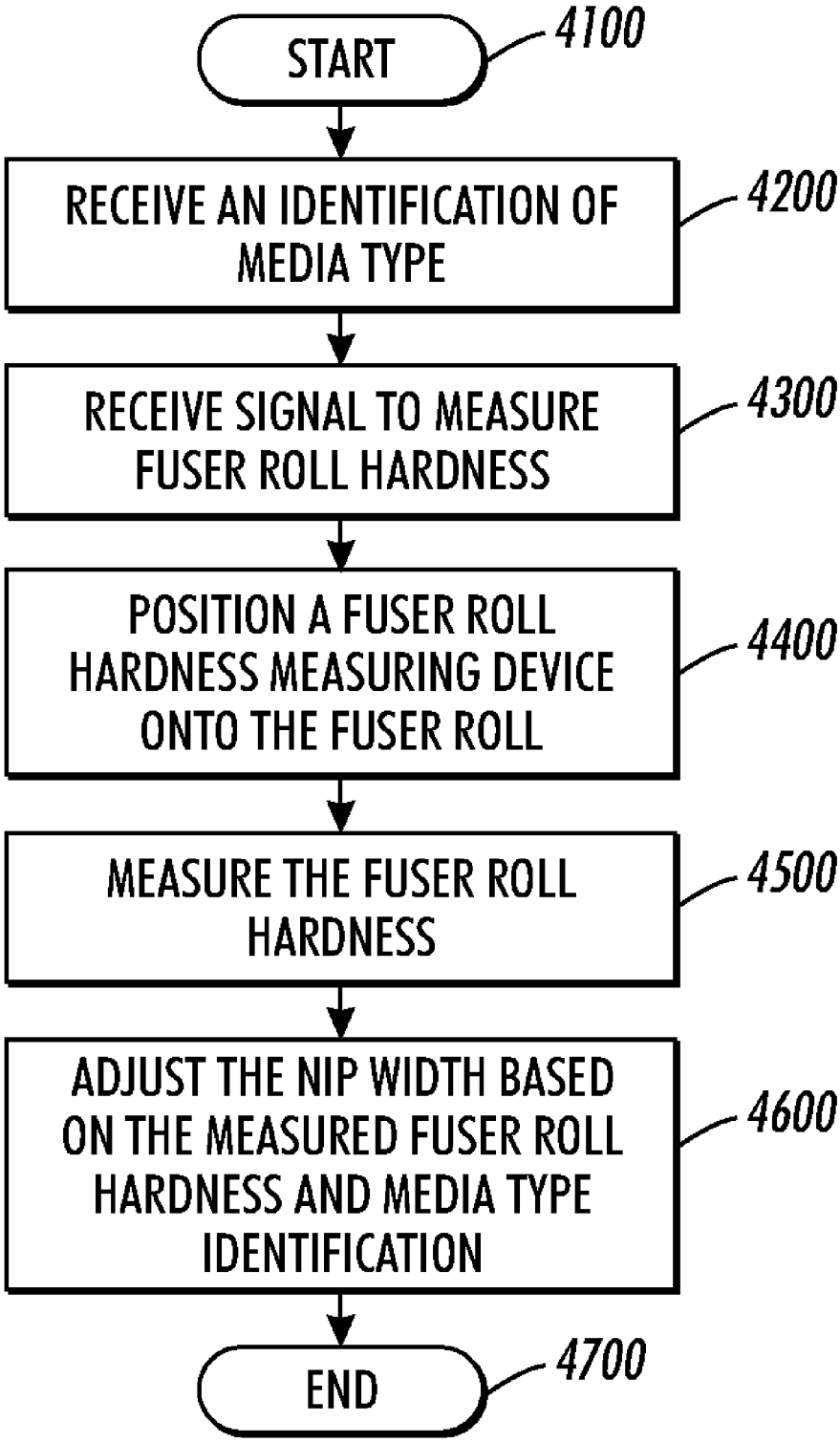
FIG. 4 is a flowchart of an exemplary a nip width adjusting process in accordance with one possible embodiment of the disclosure.

FIG. 4 is a flowchart of an exemplary fuser roll hardness measurement process in accordance with one possible embodiment of the disclosure. The method begins at 4100, and continues to 4200 where the nip width adjustment unit 250 may receive an identification of media type contained the trays 160 of the machine or the media type identified for a particular print job, for example. The media type identification may be received from an input at the user interface 150 or automatically from the trays 160, for example.

At step 4300, the nip width adjustment unit 250 may receive a signal to measure fuser roll hardness. At step 4400, the nip width adjustment unit 250 may position the fuser roll hardness measurement unit 295 onto the fuser roll.

At step 4500, the fuser roll hardness measurement unit 295 may measure the fuser roll hardness and the nip width adjustment unit 250 may receive the fuser roll hardness measurements from the fuser roll hardness measurement unit 295. The fuser roll hardness measurement unit 295 may measure the fuser roll hardness automatically upon fuser roll replacement or on a periodic basis, for example. The fuser roll hardness measurement unit 295 may measure the fuser roll hardness on at least each edge of the fuser roll, for example. In addition, the fuser roll may be rotated and the fuser roll hardness measurement unit 295 may take a plurality of fuser roll hardness measurements and the measurements may be averaged to produce the measured fuser roll hardness.

At step 4600, the nip width adjustment unit 250 may adjust the nip width based on the measured fuser roll hardness and received media type identification. In this manner, the nip width adjustment unit 250 may retrieve one or more look-up tables (or databases) for measured fuser roll hardness and may determine whether the nip width requires adjusting based upon the measured fuser roll hardness found in the look-up table. The look-up tables or databases may be stored in memory 230, for example. The process may then go to step 4700 and end.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for adjusting nip width based on the measured hardness of a fuser roll in an image production device, comprising:

receiving an identification of media type;

receiving a signal to measure fuser roll hardness;

positioning a fuser roll hardness measurement unit onto the fuser roll;

measuring the fuser roll hardness; and adjusting the nip width based on the measured fuser roll hardness and received media type identification.

2. The method of claim 1, wherein the fuser roll hardness measurement unit is a compression testing device.

3. The method of claim 1, wherein the fuser roll is rotated and a plurality of fuser roll hardness measurements are taken and averaged to produce the measured fuser roll hardness.

4. The method of claim 1, wherein the fuser roll hardness is measured automatically upon at least one of fuser roll replacement and on a periodic basis.

5. The method of claim 1, wherein the fuser roll hardness is measured on at least each edge of the fuser roll.

6. The method of claim 1, further comprising:

retrieving one or more look-up tables for measured fuser roll hardness; and determining whether the nip width requires adjusting based upon the measured fuser roll hardness found in the look-up table.

7. The method of claim 1, wherein the image production device is one of a copier, a printer, a facsimile device, and a multi-function device.

8. An image production device, comprising:

a fuser roll hardness measurement unit that measures fuser roll hardness; and a nip width adjustment unit that receives an identification of media type, receives the fuser roll hardness measurements from the fuser roll hardness measurement unit, and adjusts the nip width based on the measured fuser roll hardness and received media type identification.

9. The image production device of claim 8, wherein the fuser roll hardness measurement unit is a compression testing device.

10. The image production device of claim 8, wherein the fuser roll is rotated and the fuser roll hardness measurement unit takes a plurality of fuser roll hardness measurements and the measurements are averaged to produce the measured fuser roll hardness.

11. The image production device of claim 8, wherein the fuser roll hardness measurement unit measures the fuser roll hardness automatically upon at least one of fuser roll replacement and on a periodic basis.

12. The image production device of claim 8, wherein the fuser roll hardness measurement unit measures the fuser roll hardness on at least each edge of the fuser roll.

13. The image production device of claim 8, wherein the nip width adjustment unit retrieves one or more look-up tables for measured fuser roll hardness, and determining whether the nip width requires adjusting based upon the measured fuser roll hardness found in the look-up table.

14. The image production device of claim 8, wherein the image production device is one of a copier, a printer, a facsimile device, and a multi-function device.

15. A non-transitory computer-readable medium storing instructions for controlling a computing device for adjusting nip width based on the measured hardness of a fuser roll in an image production device, the instructions comprising:

receiving an identification of media type;

receiving a signal to measure fuser roll hardness;

positioning a fuser roll hardness measurement unit onto the fuser roll;

measuring the fuser roll hardness; and adjusting the nip width based on the measured fuser roll hardness and received media type identification.

16. The computer-readable medium of claim 15, wherein the fuser roll hardness measurement unit is a compression testing device.

17. The computer-readable medium of claim 15, wherein the fuser roll is rotated and a plurality of fuser roll hardness measurements are taken and averaged to produce the measured fuser roll hardness.

18. The computer-readable medium of claim 15, wherein the fuser roll hardness is measured automatically upon at least one of fuser roll replacement and on a periodic basis.

19. The computer-readable medium of claim 15, wherein the fuser roll hardness is measured on at least each edge of the fuser roll.

20. The computer-readable medium of claim 15, further comprising:

retrieving one or more look-up tables for measured fuser roll hardness; and determining whether the nip width requires adjusting based upon the measured fuser roll hardness found in the look-up table.

21. The computer-readable medium of claim 15, wherein the image production device is one of a copier, a printer, a facsimile device, and a multi-function device.

* * * * *